US011718446B2

(12) United States Patent
Piech

(10) Patent No.: US 11,718,446 B2
(45) Date of Patent: Aug. 8, 2023

(54) CONTAINER FOR HERMETICALLY SEALED STORAGE OF PRODUCTS, IN PARTICULAR FOODSTUFFS

(71) Applicant: Gregor Anton Piech, Ellmau (AT)

(72) Inventor: Gregor Anton Piech, Ellmau (AT)

(73) Assignee: Gregor Anton Piech, Ellmau (AT)

( * ) Notice: Subject to any disclaimer, the term of this patent is extended or adjusted under 35 U.S.C. 154(b) by 321 days.

(21) Appl. No.: 16/603,011

(22) PCT Filed: May 12, 2017

(86) PCT No.: PCT/EP2017/061472

§ 371 (c)(1),
(2) Date: Oct. 4, 2019

(87) PCT Pub. No.: WO2018/184703

PCT Pub. Date: Oct. 11, 2018

(65) Prior Publication Data

US 2020/0031520 A1 Jan. 30, 2020

(30) Foreign Application Priority Data

Apr. 5, 2017 (EP) ..... 17165039

(51) Int. Cl.
*B65D 17/28* (2006.01)
*B65D 17/42* (2006.01)

(52) U.S. Cl.
CPC ..... *B65D 17/4011* (2018.01); *B65D 17/404* (2018.01); *B65D 17/42* (2018.01);
(Continued)

(58) Field of Classification Search
CPC .. B65D 17/4011; B65D 17/404; B65D 17/42; B65D 2517/0013; B65D 2517/0038;
(Continued)

(56) References Cited

U.S. PATENT DOCUMENTS 5,770,290 A * 6/1998 McHenry ..... B21D 51/383 428/43
8,844,744 B2 * 9/2014 Lucas ..... B65D 43/265 220/254.3
(Continued)

FOREIGN PATENT DOCUMENTS

EP 0475861 A1 3/1992
EP 2157023 A1 * 2/2010 ..... B65D 17/4011
(Continued)

OTHER PUBLICATIONS

United Arab Emirates International Center for Patent Registration. Examination Report for AE Application No. P6001414/2019 and English translation, dated Mar. 29, 2023, pp. 1-5.
(Continued)

*Primary Examiner* — Jennifer Robertson
*Assistant Examiner* — Eric C Baldrighi
(74) *Attorney, Agent, or Firm* — Vivacqua Crane, PLLC

(57) ABSTRACT

Disclosed is a container for hermetically sealed storage of liquid, paste-like and/or solid products, more particularly foodstuffs, characterized in that the lid of the container is designed to be re-sealable and largely stable pull-tab lid is also provided, the opening of the lid not involving the separation of metal surface leading to swarf formation and the re-sealing of said lid for air tightness.

17 Claims, 3 Drawing Sheets

(52) U.S. Cl.
CPC ..... *B65D 2517/0013* (2013.01); *B65D 2517/0038* (2013.01); *B65D 2517/0082* (2013.01)

(58) Field of Classification Search
CPC ..... B65D 2517/0082; B65D 17/34; B65D 2577/2041; B65D 81/1275; B65D 2517/5032; B65D 2517/0086; B65D 17/4014
USPC ..... 220/270
See application file for complete search history.

(56) References Cited

U.S. PATENT DOCUMENTS

| | | | | |
|---|---|---|---|---|
| 10,273,044 | B2 * | 4/2019 | Thielen | B65D 17/4014 |
| 10,875,690 | B2 * | 12/2020 | Robin | B65D 43/16 |
| 10,968,010 | B1 * | 4/2021 | Zabaleta | B65D 41/04 |
| 2006/0201944 | A1 * | 9/2006 | Shibasaka | B29C 43/18 220/254.1 |
| 2013/0020326 | A1 * | 1/2013 | Thielen | B21D 51/383 220/270 |
| 2016/0000246 | A1 | 1/2016 | Vanderstraeten | |
| 2016/0355306 | A1 * | 12/2016 | Robin | B65D 1/165 |
| 2019/0241309 | A1 * | 8/2019 | Piech | B65D 17/404 |

FOREIGN PATENT DOCUMENTS

| | | | | |
|---|---|---|---|---|
| EP | 2354022 | A1 * | 8/2011 | B65D 17/4014 |
| EP | 2354022 | B1 | 12/2012 | |
| EP | 3385184 | A1 * | 10/2018 | B65D 17/42 |
| JP | 2015151152 | A | 8/2015 | |
| WO | WO-2011095318 | A1 * | 8/2011 | B65D 47/103 |
| WO | WO-2013004417 | A1 * | 1/2013 | B32B 15/08 |
| WO | WO-2015128847 | A1 * | 9/2015 | B65D 47/0838 |
| WO | 2017016686 | A1 | 2/2017 | |
| WO | WO-2017016686 | A1 * | 2/2017 | B65D 17/4014 |
| WO | WO-2018184703 | A1 * | 10/2018 | B65D 17/42 |

OTHER PUBLICATIONS

United Arab Emirates International Center for Patent Registration. Search Report for AE Application No. P6001414/2019 and English translation, dated Mar. 29, 2023, pp. 1-4.

* cited by examiner

CONTAINER FOR HERMETICALLY SEALED STORAGE OF PRODUCTS, IN PARTICULAR FOODSTUFFS

CROSS REFERENCE TO RELATED APPLICATIONS

This application is a national stage application under 35 U.S.C. 371 of PCT Application No. PCT/EP2017/061472 having an international filing date of 12 May 2017, which PCT application claimed the benefit of European Patent Application No. 20170165039 filed 5 Apr. 2017, the entire disclosure of each of which are hereby incorporated herein by reference.

TECHNICAL FIELD

The invention relates to a receptacle for a hermetically sealed storage of liquid, pasty, and/or solid products, in particular foods, comprising a product container that is open at one side and a tear open end that is connected in an airtight manner to the product container, in particular via a beaded margin, an adhesive connection, or a welded connection, or the like.

INTRODUCTION

A plurality of products of the most varied kind, in particular foods, are packed in receptacles closed in a sealed manner to ensure long shelf lives so that only a minimal impairment of the quality or of the properties of the respective products takes place during this storage time.

Examples for this widespread type of packaging are cans for fish, meat, sausage, fruit, vegetables, ready meals, and the like, but are also receptacles closed in a hermetically sealed manner outside the food sector for packaging enamels, paints, and other pasty products, for example, to ensure that their properties present after manufacture remain unchanged over a long time and correspondingly long storage times can thus also be ensured with a minimal loss of quality.

If such receptacles closed in a hermetically sealed manner, for example cans, are provided with a tear open end, i.e. with a metal end having a scored line introduced and having a pull tab riveted to the end, such inexpensively producible receptacles in particular have the advantage that no closure elements project over the outer contour of the receptacle and the demands for stackability and thus favorable transport and storage options can thus be satisfied.

It is above all a disadvantage in this respect that a receptacle opened via the tear open end cannot be closed again and the product present in the receptacle thus has to be used immediately or has to be transferred to a closable receptacle. A particular disadvantage is additionally present in the case of foods packaged in metal receptacles and this disadvantage comprises tiny metal particles unavoidably being released from the end material and being able to move into the can or onto the packaged product in the opening procedure, i.e. when the existing score line or weakening line between the respective opening region and the end surface is torn open or separated. These tiny splinters or metal particles are critical in a health respect when they enter into the human body together with the food.

SUMMARY

It is the object of the present invention to provide a receptacle of the initially named kind having all the advantages inherent in such receptacles, but in particular in so doing to achieve the opening of the ends being made possible with comparatively smaller force expenditure and with a simple handling, disruptive deformations of the upwardly pivoted end region being avoided in the same way as the risk of injury due to sharp metal margins, and above all the occurrence and release of metal microparticles also being precluded in the opening procedure.

This object is substantially achieved in accordance with the invention in that the tear open end is configured as reclosable and comprises a composite material in the form of a sheet metal layer, in particular composed of aluminum or tin plate, bonded to a plastic film by means of e.g. a molecular or atomic bond, i.e. "Stoffschlüssig", in particular via an adhesive lacquer film; in that the sheet metal layer and the enamel film of the peripheral line of the respectively provided opening region or tear open region are pierced or punched through accordingly while forming a microgap; in that the plastic film disposed on the inner receptacle side and closing the microgap is provided at a small distance from the microgap with a weakening or with a notch extending at least regionally largely over the film thickness; in that a peripheral stiffening and coupling frame having at least one sealing and latching rib is fastened to the outer end side on the marginal region of the upwardly pivoted end region that is bounded by the microgap;

in that a sealing frame that is engaged over by the stiffening and coupling frame is likewise fastened to the outer end side on the fixed end surface adjacent to the microgap and outside the opening region and has grooves for a sealing reception of the sealing and latching ribs provided at the stiffening and coupling frame, with the position of the sealing and latching ribs, on the one hand, and of the reception grooves, on the other hand, being able to be swapped over; and In that the end part formed by the end region bounded by the microgap and the stiffening and coupling frame fastened thereto is, on the one hand, provided with a tear open member connected in an articulated manner to the outer margin of the stiffening and coupling frame and is, on the other hand fixedly connected to the end surface disposed outside the upwardly pivotable end part via a pivot bearing region molded to the stiffening and coupling frame diametrically opposite said tear open member.

It is essential to the solution in accordance with the invention that the upwardly pivotable metal end region is fixedly connected over its total periphery to a stiffening and coupling frame and thus an upwardly pivotable end part is provided that is largely stable per se, that can be pressed back into the sealing frame after the first opening has taken place, and that ensures a reliable closure of the receptacle therewith while forming a sealing coupling.

An undefined bending of the metal opening region such as occurs as a rule in conventional can ends that can be torn open is precluded as is the risk of injury at sharp metal edges since such sharp edges are covered by the stiffening and coupling frame.

It is furthermore of importance that the design of the composite material makes it possible, despite the punching of the end region that has taken place and the subsequent fitting of this region into the metal end, to obtain a metallic, practically continuous end surface that is sealed despite the punching and to whose outer side both the stiffening and coupling frame and the sealing frame are fastened, and indeed in a manner such that no continuous fastening openings have to be carried out in the metal end or metal moldings. This produces an extremely simple and also inexpensive design.

While the can end or tear open end of the receptacle is always metal due to the demands made on it, the product container to which the can end is connected can comprise both metal and plastic or other materials, in particular also composite materials.

The weakening or the notch of the plastic film closely adjacent to the microgap does not have to be peripheral or peripherally the same. For example, to make possible the decrease of an excess pressure built up in the inner space of the receptacle, the notch depth can be advantageously increased in that region that becomes effective at the start of the opening procedure and the opening can thus be facilitated. A short region of reduced notch depth preferably adjoins this region of increased notch depth and has the consequence of noticeable increase of the opening resistance and thus a brief braking of the opening procedure. The notch depth and can in turn be increased subsequent to this and can preferably correspond to the initial notch depth. An excess pressure present in the initial phase of the respective opening procedure is thus reduced in a simple and reliable manner, whereupon after overcoming a brief stoppage, the further opening procedure can then take place at normal pressure and an unwanted escape of liquid through the sealing lip arrangement is prevented in so doing.

In accordance with various embodiments of the invention, the receptacle can have a round, oval, or polygonal cross-sectional shape, with the extent of the microgap in this case being at least partly adapted to the respective cross-sectional shape.

Specifically designed, and in particular polygonal, cross-sectional shapes make possible a tighter packing of receptacles and thus corresponding storage and transport advantages. In addition, sales areas can be better utilized by a denser arrangement of the receptacles. The adaptation of the upwardly pivotable end part to the respective cross-sectional shape ensures ideal access to the inner space of the product receptacle.

The sealing frame intended to receive the end part preferably at least largely follows in its peripheral extent the extent of the connection region between the product receptacle and the end with any cross-sectional shape of the receptacle, which is equivalent to the peripheral contour of the upwardly pivotable end part being approximately adapted to the cross-sectional shape of the receptacle in these cases.

It is furthermore essential to the invention that the plastic film component as the molding adapted to the lower side end contour is formed with molded positioning elements. In this manner, the relative position of the plastic film and of the sheet metal layer can always be simply and exactly predefined and ensured.

The film component of the composite material preferably extends up to and into the beaded margin and acts as a sealing material and as corrosion protection in the beaded connection, which produces a further simplification with cans.

It is furthermore of advantage that the pivot bearing region has an integrated bistable toggle spring section. The latter holds the end comprising the metal opening region, the stiffening and coupling frame fastened thereto, and the tear open member, open to more than 130° when exceeding approximately 90° so that the inner space of the respective receptacle is ideally accessible. On a falling below of approximately 90°, the end snaps back to an opening angle of less than 30°. The end part can again be pressed into the sealing closing position from the open position. This procedure can be carried out reversibly a plurality of times in both directions.

It is of importance with respect to existing hygienic demands that the stiffening and coupling frame preferably has a sealing skirt that extends up to the fixed position end surface over its total outer periphery and that is in particular bonded to the fixed position end surface via the adhesive layer by means of e.g. a molecular or atomic bond, i.e. "Stoffschlüssig".

Any penetration of contamination, moisture, and the like into regions disposed beneath the visible plastic parts is thus most certainly prevented, which is above all of particular importance with packaged products having long storage times.

Further advantageous features and aspect of the invention are set forth in the dependent claims and will also be explained in the following description of an embodiment with reference to the drawing.

DETAILED DESCRIPTION

Figure 1:
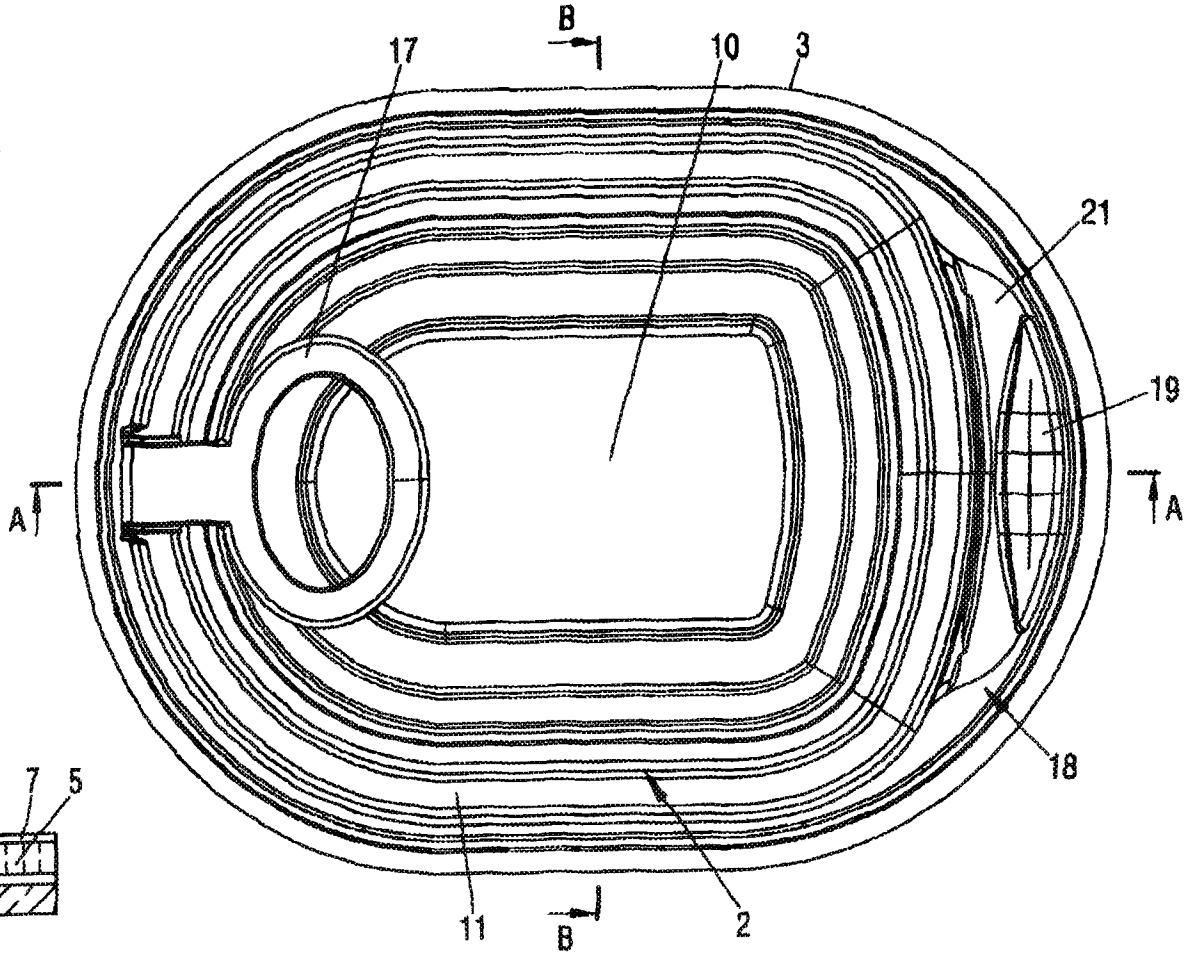
FIG. 1 is a schematic plan view of a receptacle in accordance with the invention in the form of a typical fish can.

The plan view in accordance with FIG. 1 shows as a non-restrictive embodiment of the invention, a metal fish can that is hermetically closed and that can be opened via a tear open end 2. For this purpose, an opening region is provided in the can end that can be opened and pivoted up via a tear open member 17 via means still to be shown and described in detail, and indeed via a pivot bearing region 18 whose fixed part 19 is fastened to the can end. A toggle spring section 21 that permits the end pivoted up to be held in a stable open position is provided here between this fixed part 19 and a stiffening and coupling frame 11 fixedly connected to the upwardly pivotable metal end region 10.

Figure 2:
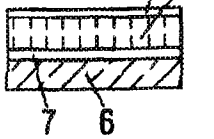
FIG. 2 is a greatly enlarged schematic sectional representation for explaining the setup of the composite material used within the framework of the invention.

The can end in accordance with the invention preferably comprises a composite material whose design is shown schematically and in a greatly enlarged form in FIG. 2.

The main component of the can end comprises a suitably shaped sheet metal layer 5, preferably composed of aluminum or tin plate, and this sheet metal layer is at both sides respectively with an adhesive layer 7 that serves as an adhesive agent and that makes it possible to ensure a very strong and permanent bond by means of e.g. a molecular or atomic bond between the metal, in particular aluminum or tin plate, and the plastic of the film 6 that preferably comprises polypropylene, that is provided at the lower end side, i.e. at the inner can side, and that is suitable for use in foods. The mutual connection of the individual components preferably takes place by induction in a so-called heat seal process or by plastic welding.

A practically significant advantage of this composite is that it makes it possible to reduce the material thickness of the sheet metal layer 5, in particular of the aluminum or tin plate layer, without compromises with respect to the required strength values, with a small reduction in the sheet metal thickness already making possible economically substantial material savings when the large volumes in which such packages are required and produced are taken into account. In particular a mechanical strength of the plastic film 6 component in the composite material is selected such that the material thickness of the sheet metal layer 5 metal component is reduced in comparison with a film-free component while ensuring the required total strength of the composite material 4. The material thickness of the sheet metal layer 5 may be thereby be reduced by at least 5%.

Figure 3:
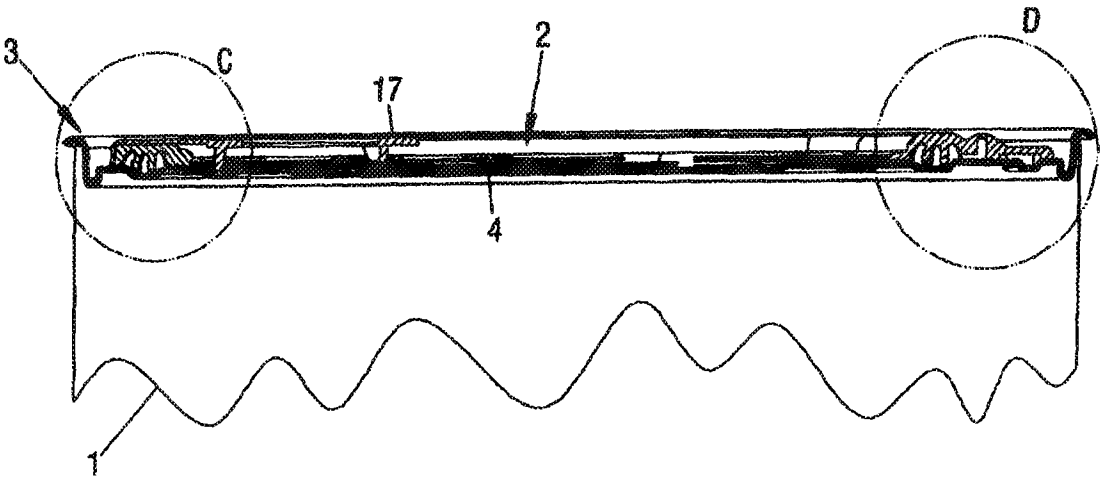
FIG. 3 is a section corresponding to the line A-A in FIG. 1.

FIG. 3 shows a section corresponding to the line A-A in FIG. 1, with the connection of the end to the respective product container 1 being schematically indicated in this sectional representation. The product container 1 preferably comprises metal, but can also comprise other materials, in particular plastic, with then the respective suitable connection technique, e.g. adhesion, being used to connect the container 1 with the can end in a hermetically sealed manner.

The details of the can end design essential for the function are located in the regions marked by C and D and will be explained separately in the following with references to FIGS. 4 and 5.

Figure 4:
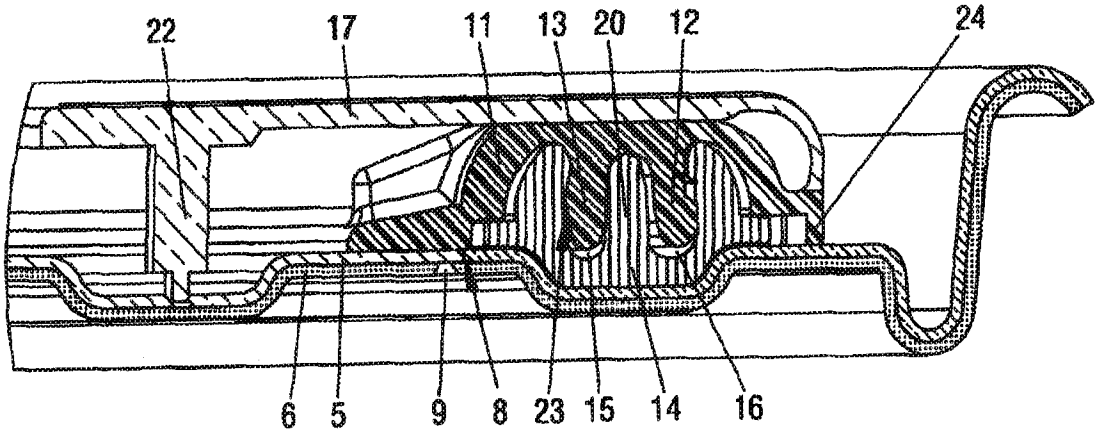
FIG. 4 is an enlarged representation of the detail C from FIG. 3.

FIG. 4 shows in a highly enlarged form the region D of FIG. 3, i.e. the region at which the tear open member 17 is fastened to the upwardly pivotable end part, and indeed at its outer margin, so that on a pulling up of the end part, a lever effect is preferably produced that promotes the opening of the end part.

The can end comprises the composite material schematically shown in FIG. 2, with only the sheet metal layer 5 and the plastic film 6 comprising a plastic molding being shown in FIG. 4 for reasons of simplicity. The molding contour of the plastic film 6 corresponds to the contour of the lower side of the sheet metal end part 5 and preferably extends up to and into the beaded region where it can simultaneously act as a seal and as corrosion protection.

The end region 10 indicated in FIG. 1 is provided in the can end material 5 and, in accordance with the invention, is not bounded by a material weakening, but rather by a so-called microgap 8. This peripheral microgap 8 is preferably formed in that the end region 10 is punched out of the sheet metal material and is subsequently, or in the further course of the production process, pressed back into the opening again so that a planar metal surface is in turn present. The punching process is preferably configured such that a peripheral contour results in the punched part that, observed over the material thickness, comprises a flush-cut section and an adjoining chamfer-cut section, with the flush-cut section preferably extending over less than 50% of the material thickness.

A clamping hold is thus present in the region of the microgap 8 between the sheet metal parts pushed into one another again so that on the first opening of the receptacle, a metal separation no longer has to take place and thus also no formation of metal microparticles occurs. Such an occurrence of microparticles, in particular microparticles of aluminum, cannot be prevented in conventional can ends having closed tear open lines.

The microgap 8, that is preferably formed by a straight line, i.e. a non-toothed line, is covered and thus sealed by the plastic film 6 at the lower side, i.e. at the inner end side. The plastic film has a more or less deep notch 9 adjacent to the microgap 8, said notch 9 ensuring that only a comparatively small force is required to open the end, with the total force required for the opening also being able to be predefinable by the seal pairing that is implemented in the cooperation of the sealing frame 14 and of the stiffening and coupling frame 11.

The sealing frame 14 composed of plastic material, e.g. polypropylene, surrounds the opening region and is fixedly connected, preferably in a recess of the sheet metal layer 5, to the metal end material via the already mentioned adhesive lacquer film.

The sealing frame has two reception grooves 15, 16, divided from one another by a center web 20, for a latching rib 12 and a sealing rib 13 that are provided at the stiffening and coupling frame 11. This stiffening and coupling frame 11, likewise comprising plastic material, preferably polypropylene, is in an analog manner to the sealing frame 14 fixedly connected to the metal end, but not to the fixed position end part, but rather to the upwardly pivotable end region 10. The upwardly pivotable end part is thus formed by the metal end region bounded by the microgap and by the stiffening and coupling frame 11 that is fastened thereto at the marginal side, that gives the end part the desires surface stability, and that prevents an unwanted deformation of the end part.

The tear open member 17 is molded to the outer margin of the stiffening and coupling frame 11 and a pivot bearing region 18 is likewise arranged molded diametrically opposite thereto and is fixedly connected to the end surface disposed outside the upwardly pivotable end part, which will be explained with reference to FIG. 5.

The tear open member 17 has a fixing element 22 that extends toward the end part and is fixed there such that the intactness of the respective packaging is visible or can be checked with reference to this connection.

Figure 5:
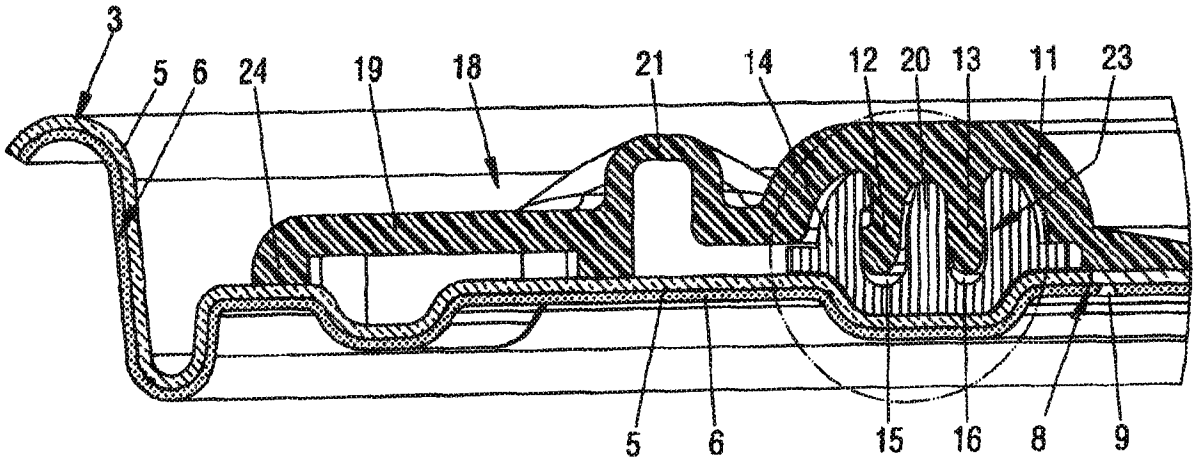
FIG. 5 is an enlarged representation of the detail D from FIG. 3.

FIG. 5 shows in an enlarged representation the detail region D of FIG. 3, i.e. the pivot bearing region 18 disposed diametrically opposite the tear open member 17 in connection with the sealing frame 14 and the stiffening and coupling frame 11 that are in engagement with one another in the shown manner and that form a sealing snap and latch connection in the closed state of the can end.

The rib 13 received in the reception groove 16 and the rib 12 received in the reception groove 15 are functionally different, i.e. separate functions are present, whereby an optimization of the cooperation of the sealing frame 14 and the stiffening and coupling frame 11 is made possible. The sealing rib 13 forms a sealing surface pairing 23 with the receiving rib 16, with the opening resistance being able to be set by the predefinable inclination of the mutually cooperating sealing surfaces, i.e. a slanted surface pairing can be selected that ensures that, on the one hand, it is possible to withstand the respective internal pressure and, on the other hand, the opening process is not made too difficult.

The latching rib 12 and the associated reception groove 15 likewise have short, mutually cooperating slanted surfaces that, on the one hand, ensure the latching snap-in connection, but, on the other hand, also make possible a small free relative movement with respect to one another. This free movability can be used to permit a small initial opening of the can end on which a possible internal pressure is reduced without the end already being opened so far that liquid could escape in a disruptive manner.

The stiffening and coupling frame 11 is connected to the fixed part of the pivot bearing via a toggle spring section 21 that makes it possible to hold the end region pivoted up in a position pivoted up of e.g. more than 130° so that the opening region of the can is freely accessible.

To ensure that no dirt particles or contaminants can penetrate under the can end region covered by the plastic parts, provision is made in accordance with a further special feature of the invention that the stiffening and coupling frame 11 has a sealing skirt 24 over its total outer periphery that extends up to the fixed position end surface and that is preferably bonded to the fixed position end surface with e.g. a molecular or atomic bond via the adhesive lacquer film 7. This connection is separated on the first opening.

A receptacle formed in accordance with the invention with a reclosable end has a number of advantages with respect to previously known food receptacles or food cans. No separate end thus has to be used or the can can be closed by an aluminum foil or in another manner. In addition, the end designed in accordance with the invention does not bend like the ends of conventional tear open cans and receptacles of the most varied cross-sectional shapes can be freely used, with the opening cross-section being freely configurable. The reclosable end in accordance with the invention increases the leak tightness and security with respect to an unintended opening and the problem of a formation of metal splinters or microparticles and the health hazard resulting therefrom is also above all fully avoided that has always been present with the previously known metal cans.

In addition to food containers, receptacles configured in accordance with the invention can also be used in the non-food sector, for example for oils and enamels, and equally also in receptacles in which products only have to be stored at a specific pressure, e.g. receptacles for tennis balls. The area of use of receptacles having a reclosable end and configured in accordance with the invention is thus practically unlimited.

REFERENCE NUMERAL LIST

1 product container, can body
2 tear open end
3 beaded margin
4 composite material
5 sheet metal layer (aluminum, tin plate)
6 plastic film, molding
7 adhesive lacquer film
8 microgap
9 notch
10 end region, upwardly pivotable
11 stiffening and coupling frame
12 latching rib
13 sealing rib
14 sealing frame
15 reception groove, inner
16 reception groove, outer
17 tear-open member
18 pivot bearing region
19 fixed part of the pivot bearing
20 central web
21 toggle spring section
22 fixing element
23 sealing surface pairing
24 sealing skirt

The invention claimed is:

1. A receptacle for a hermetically sealed storage of liquid, paste, and/or solid products, the receptacle comprising; a product container open at an open side and a tear open end connected in an airtight manner to the open side of the product container via a beaded margin or via an adhesive connection, or a welded connection, wherein the open side of the product container has a first container curvature and a second container curvature diametrically opposed from the first container curvature, wherein the tear open end is reclosable, and comprises a composite material in the form of a sheet metal layer bonded to a plastic film;

wherein the sheet metal layer and a lacquer film at a peripheral line of a respective provided opening region is pierced or punched through accordingly while forming a microgap;

wherein the plastic film disposed on an inner receptacle side and closing the microgap is provided at a distance from the microgap with a weakening or with a notch extending at least regionally over a thickness of the plastic film;

wherein a peripheral stiffening and coupling frame having at least one sealing and latching rib is fastened to an outer end side on a marginal region of an upwardly pivotable end region and that is bounded by the microgap;

wherein a sealing frame that is engaged over by the stiffening and coupling frame is likewise fastened to an outer end side on a fixed end surface adjacent to the microgap and outside the opening region and has reception grooves for a sealing reception of the sealing and latching ribs provided at the stiffening and coupling frame, wherein the sealing frame has a first sealing frame curvature proximal to the first container curvature of the open side of the product container and a second sealing frame curvature proximal to the second container curvature of the open side of the product container, wherein a position of the sealing and latching ribs is swappable, and wherein a position of the reception grooves, is swappable;

wherein an end part formed by the upwardly pivotable end region bounded by the microgap and by the stiffening and coupling frame fastened thereto is, provided with a tear open member connected in an articulated manner to an outer margin of the stiffening and coupling frame and is, fixedly connected to the fixed end surface disposed outside the upwardly pivotable end part via a pivot bearing region molded to the stiffening and coupling frame diametrically opposite said tear open member, wherein the pivot bearing region is proximal to the first container curvature of the open side of the product container and the tear open member is proximal to the second container curvature of the open side of the product container;

wherein a radius of the first sealing frame curvature is different from a radius of the first container curvature, and wherein a radius of the second sealing frame curvature is the same as a radius of the second container curvature; and wherein an area of the opening region is at least fifty percent of an area of the open side of the product container.

2. The receptacle in accordance with claim 1, wherein the receptacle is for a hermetically sealed storage of foods.

3. The receptacle in accordance with claim 1, wherein the sheet metal layer is composed of aluminum or tin plate.

4. The receptacle in accordance with claim 1, wherein the sheet metal layer is bonded to the plastic film via an adhesive lacquer film.

5. The receptacle in accordance with claim 1, wherein the receptacle has a round, oval, or polygonal cross-sectional shape and the extent of the microgap is at least partly adapted to the respective cross-sectional shape.

6. The receptacle in accordance with claim 1, wherein the stiffening and coupling frame, the sealing frame, and a fixed part of the pivot bearing region are connected to an end material in a sealing and fixed manner.

7. The receptacle in accordance with claim 6, wherein the stiffening and coupling frame, the sealing frame, and the fixed part of the pivot bearing region are connected via an adhesive lacquer film to the end material in a sealing and fixed manner.

8. The receptacle in accordance with claim 1, wherein the tear open member generates a pushing force via a lever translation that becomes effective at a start of a movement, said pushing force acting, adjacent to the microgap, on the punched out end region and separating the region of the plastic film covering the microgap from a fixed position end material in a further opening process.

9. The receptacle in accordance with claim 8, wherein the tear open member is configured as a ring pull.

10. The receptacle in accordance with claim 1, wherein a plastic film layer is configured as a molding adapted to a lower side end contour of the receptacle and having molded positioning elements.

11. The receptacle in accordance with claim 10, wherein the molded positioning elements comprise knobs that engage into corresponding recesses of an end material.

12. The receptacle in accordance with claim 1, wherein the plastic film component of the composite material extends up to and into the beaded margin and acts as a sealing material and as corrosion protection in the beaded margin.

13. The receptacle in accordance with claim 1, wherein a mechanical strength of the plastic film component in the composite material is selected such that a material thickness of the sheet metal layer is reduced in comparison with a film-free component while ensuring a required total strength of the composite material.

14. The receptacle in accordance with claim 13, wherein the material thickness of the sheet metal layer is reduced by at least 5%.

15. The receptacle in accordance with claim 1, wherein two reception grooves separated by a center web are formed in the sealing frame surrounding the opening region, with an inwardly disposed groove cooperating with a sealing rib and an outwardly disposed groove cooperating with a latching rib of the stiffening and coupling frame.

16. The receptacle in accordance with claim 1, wherein the pivot bearing region has an integrated toggle spring section that holds the end part formed by the upwardly pivotable end region, by the stiffening and coupling frame fastened thereto, and by the tear open member in an open position of more than 130° after exceeding an opening angle of approximately 90° and that allows the end part to snap into an angular position of less than 30° on a closing procedure after falling below an angle of approximately 90°.

17. The receptacle in accordance with claim 1, wherein a total outer periphery of the stiffening and coupling frame has a sealing skirt that extends up to the fixed end surface and that is bonded to the fixed end surface via an adhesive lacquer film.

* * * * *